US006117021A

United States Patent [19]

Crow et al.

[11] Patent Number: 6,117,021

[45] Date of Patent: Sep. 12, 2000

[54] GOLF CLUB SHAFT

[75] Inventors: Thomas L. Crow, La Jolla; Bret A. Newmiller, San Diego; William F Davidson, III, Costa Mesa, all of Calif.; Daniel L. Weaver, Middleton, Wis.; Tsao Hsien Hwang, San Diego, Calif.; George D. Wever, III, Carlsbad, Calif.; Pascal Stolz, Del Mar, Calif.

[73] Assignee: Cobra Golf, Incorporated, Carlsbad, Calif.

[21] Appl. No.: 08/997,893

[22] Filed: Dec. 24, 1997

Related U.S. Application Data

[63] Continuation-in-part of application No. 08/672,362, Jun. 28, 1996, Pat. No. 5,935,017, and a continuation-in-part of application No. 29/075,725, Jul. 8, 1997, Pat. No. Des. 418,566.

[51] Int. Cl.[7] ..... A63B 53/10

[52] U.S. Cl. ..... 473/289; 473/319; 473/323; 473/318

[58] Field of Search ..... 473/316–323, 473/287–291

[56] References Cited

U.S. PATENT DOCUMENTS

| | | | |
|---|---|---|---|
| Re. 33,735 | 11/1991 | Rumble et al. . | |
| D. 92,571 | 6/1934 | Barnhart . | |
| Re. 96,020 | 10/1869 | Lyons . | |
| D. 245,441 | 8/1977 | Middlestadt . | |
| D. 246,003 | 10/1977 | Shimada . | |
| D. 250,356 | 11/1978 | Kaugers . | |
| D. 263,330 | 3/1982 | Kaugers et al. . | |
| D. 315,386 | 3/1991 | Alonso . | |
| D. 327,309 | 6/1992 | Shigetoh . | |
| D. 351,643 | 10/1994 | Gubany . | |
| D. 352,755 | 11/1994 | Cornish, III . | |
| D. 385,608 | 10/1997 | Hoffmeyer . | |
| 391,994 | 10/1888 | Flotow et al. . | |
| 695,579 | 3/1902 | Parmele . | |
| 976,267 | 11/1910 | Knight | 473/316 |

(List continued on next page.)

FOREIGN PATENT DOCUMENTS

| | | |
|---|---|---|
| 2 667 794 | 4/1992 | France . |
| 3-251269 | 11/1991 | Japan . |
| 09271548 | 10/1997 | Japan . |
| 24144 | 12/1911 | United Kingdom . |
| 256049 | 8/1926 | United Kingdom . |
| 360097 | 11/1931 | United Kingdom . |

(List continued on next page.)

OTHER PUBLICATIONS

1997 Black Rock Catalog.

Links Profile, A Supplement to Links Magazine, "Fenwick Fine Tunes Shaft Technology, Industry Giants Keep an Eye on Iowa," Apr. 1996.

Stachura, Mike, "Shape Up Your Shafts," Golf Digest, Dec. 1997, pp. 88–95.

Advertisement: "New Clubs for 1938: True Temper Steel Shafts," Oct. 3, 1938, cover p., and p. 8–9.

*Primary Examiner*—Jeanette Chapman
*Assistant Examiner*—Stephen L. Blau
*Attorney, Agent, or Firm*—Pennie & Edmonds LLP

[57] ABSTRACT

A set of golf shafts is disclosed. The set comprises a plurality of shafts that decrease in length along the set. Each shaft includes a reverse taper section disposed a distance from the tip section on each shaft. The distance of the reverse taper section varies along a number of shafts as the shaft length decreases.

A golf club shaft is disclosed. The shaft includes a tip section, lower section, and an upper section. The tip section connects with a golf club head. The lower section includes a tapered section and a reverse taper section. The tapered section extends from the tip section. The tapered section increases in diameter in a direction away from the tip section. The reverse taper section extends between the tapered section and the upper section. The reverse taper section has a diameter that decreases in a direction away from the tip section. The shaft further includes a resilient plug wedged inside the shaft. The plug extends along the reverse taper section, the plug being formed from a sound absorbing material.

22 Claims, 12 Drawing Sheets

U.S. PATENT DOCUMENTS

| | | | |
|---|---|---|---|
| 1,289,553 | 12/1918 | Sanders . | |
| 1,418,039 | 5/1922 | Tousey . | |
| 1,486,572 | 4/1924 | Forsyth . | |
| 1,565,069 | 12/1925 | Edwards . | |
| 1,565,070 | 12/1925 | Edwards . | |
| 1,604,696 | 12/1926 | Jordy . | |
| 1,639,864 | 8/1927 | Smith . | |
| 1,653,428 | 12/1927 | Brinkman . | |
| 1,670,530 | 5/1928 | Cowdery . | |
| 1,670,531 | 5/1928 | Cowdery . | |
| 1,688,473 | 3/1928 | Sippel . | |
| 1,713,812 | 5/1929 | Barnhart . | |
| 1,721,253 | 7/1929 | Loughead et al. . | |
| 1,765,709 | 6/1930 | Withington . | |
| 1,778,181 | 10/1930 | Brinkman . | |
| 1,781,116 | 11/1930 | Link et al. . | |
| 1,787,415 | 12/1930 | Washington . | |
| 1,796,274 | 3/1931 | Bryant . | |
| 1,840,406 | 1/1932 | McEvoy . | |
| 1,890,037 | 12/1932 | Johnson . | |
| 1,891,620 | 12/1932 | Crawford . | |
| 1,917,795 | 7/1933 | Fetter . | |
| 1,945,844 | 2/1934 | Young . | |
| 1,950,342 | 3/1934 | Meshel | 473/323 |
| 1,961,969 | 6/1934 | Heddon . | |
| 1,962,804 | 6/1934 | Cassady . | |
| 1,963,048 | 6/1934 | Cowdery . | |
| 1,974,271 | 9/1934 | Hackett . | |
| 1,974,389 | 10/1934 | Cowdery . | |
| 1,979,430 | 11/1934 | Wright . | |
| 1,980,031 | 11/1934 | Brading . | |
| 1,980,408 | 11/1934 | Jansky . | |
| 1,983,069 | 12/1934 | Cowdery . | |
| 1,983,074 | 12/1934 | Durell . | |
| 1,994,069 | 3/1935 | Fletcher . | |
| 1,997,853 | 4/1935 | Buhrke et al. . | |
| 2,001,166 | 5/1935 | Swennes . | |
| 2,001,643 | 10/1935 | Wilcox . | |
| 2,007,976 | 7/1935 | Kraeuter . | |
| 2,023,131 | 12/1935 | Gibson . | |
| 2,037,636 | 4/1936 | Lagerblade . | |
| 2,040,540 | 5/1936 | Young . | |
| 2,050,554 | 8/1936 | Barnhart | 473/323 |
| 2,066,442 | 1/1937 | Wright . | |
| 2,066,962 | 4/1937 | Cross . | |
| 2,086,275 | 3/1937 | Lemmon . | |
| 2,098,615 | 11/1937 | Cowdery . | |
| 2,113,826 | 4/1938 | Carpenter . | |
| 2,124,534 | 7/1938 | Barnhart . | |
| 2,130,395 | 9/1938 | Lard . | |
| 2,153,550 | 4/1939 | Cowdery . | |
| 2,153,880 | 12/1939 | Barnhart . | |
| 2,155,517 | 4/1939 | Turner . | |
| 2,196,742 | 4/1940 | Cowdery et al. . | |
| 2,220,852 | 11/1940 | Scott | 473/323 |
| 2,250,428 | 7/1941 | Vickery | 473/323 |
| 2,250,429 | 6/1941 | Vickery . | |
| 2,250,441 | 10/1941 | Vickery . | |
| 2,457,177 | 12/1948 | Reach . | |
| 2,464,850 | 3/1949 | Crawshaw . | |
| 2,700,547 | 1/1955 | Kraeling, Jr. . | |
| 2,934,345 | 4/1960 | Scott . | |
| 3,083,969 | 4/1963 | Bills, Jr. . | |
| 3,206,205 | 9/1965 | McLoughlin . | |
| 3,313,541 | 4/1967 | Benkoczy et al. . | |
| 3,519,270 | 7/1970 | Baymiller . | |
| 3,614,101 | 10/1971 | Hunter . | |
| 3,646,610 | 2/1972 | Jackson . | |
| 3,735,463 | 5/1973 | Merola . | |
| 3,764,137 | 10/1973 | Petro . | |
| 3,833,223 | 9/1974 | Shulkin . | |
| 3,963,236 | 6/1976 | Mann . | |
| 3,998,458 | 12/1976 | Inoue et al. . | |
| 4,000,896 | 1/1977 | Lauraitis . | |
| 4,082,277 | 4/1978 | Van Auken et al. . | |
| 4,097,626 | 6/1978 | Tennent . | |
| 4,131,701 | 12/1978 | Van Auken . | |
| 4,135,035 | 1/1979 | Branen et al. . | |
| 4,157,181 | 6/1979 | Cecka . | |
| 4,165,874 | 8/1979 | Lezatte et al. . | |
| 4,169,595 | 10/1979 | Kaugars . | |
| 4,205,845 | 6/1980 | Kanne . | |
| 4,236,386 | 12/1980 | Yates et al. . | |
| 4,240,631 | 12/1980 | MacDougall . | |
| 4,280,700 | 7/1981 | Plagenhoef | 473/289 |
| 4,288,075 | 9/1981 | Kaugars et al. . | |
| 4,319,750 | 3/1982 | Roy . | |
| 4,330,126 | 5/1982 | Rumble . | |
| 4,360,602 | 11/1982 | Nehmey | 521/95 |
| 4,361,326 | 11/1982 | Kokes | 473/206 |
| 4,415,156 | 11/1983 | Jorgensen . | |
| 4,431,187 | 2/1984 | Rumble et al. . | |
| 4,558,863 | 12/1985 | Hass et al. . | |
| 4,591,157 | 5/1986 | Parente et al. . | |
| 4,725,060 | 2/1988 | Iwanaga . | |
| 4,799,448 | 1/1989 | Junker | 116/63 P |
| 4,880,076 | 11/1989 | Ahlberg | 181/130 |
| 4,961,576 | 10/1990 | Meredith . | |
| 5,004,236 | 4/1991 | Kameshima . | |
| 5,018,735 | 5/1991 | Meredith et al. . | |
| 5,022,652 | 6/1991 | Fenton . | |
| 5,074,555 | 12/1991 | Meredith . | |
| 5,083,780 | 1/1992 | Walton et al. . | |
| 5,093,162 | 3/1992 | Fenton et al. . | |
| 5,143,374 | 9/1992 | Shibasaki . | |
| 5,156,396 | 10/1992 | Akatsuka et al. . | |
| 5,251,896 | 10/1993 | Gerlach . | |
| 5,253,867 | 10/1993 | Gafner . | |
| 5,259,614 | 11/1993 | Greer . | |
| 5,265,872 | 11/1993 | Tennent et al. . | |
| 5,277,423 | 1/1994 | Artus . | |
| 5,294,119 | 3/1994 | Vincent et al. . | |
| 5,297,791 | 3/1994 | Negishi . | |
| 5,308,062 | 5/1994 | Hogan . | |
| 5,316,299 | 5/1994 | Feche et al. . | |
| 5,316,300 | 5/1994 | Simmons . | |
| 5,324,032 | 6/1994 | Minami . | |
| 5,351,958 | 10/1994 | Helmstetter . | |
| 5,385,767 | 1/1995 | Noguchi . | |
| 5,413,338 | 5/1995 | Kawamatsu . | |
| 5,427,373 | 6/1995 | Kusumoto . | |
| 5,437,450 | 8/1995 | Akatsuka et al. . | |
| 5,439,219 | 8/1995 | Vincent . | |
| 5,467,984 | 11/1995 | Veux et al. . | |
| 5,496,028 | 3/1996 | Chien . | |
| 5,505,446 | 4/1996 | Whitaker . | |
| 5,511,780 | 4/1996 | Vadersen . | |
| 5,551,691 | 9/1996 | Harada et al. . | |
| 5,573,467 | 11/1996 | Chou et al. . | |
| 5,575,473 | 11/1996 | Turner | 473/298 |
| 5,599,242 | 2/1997 | Solviche et al. . | |
| 5,620,380 | 4/1997 | Tennent et al. | 473/319 |
| 5,632,692 | 5/1997 | Lebovici . | |
| 5,634,860 | 6/1997 | McIntosh et al. . | |
| 5,634,861 | 6/1997 | Yamamoto et al. . | |
| 5,649,328 | 7/1997 | Martin . | |
| 5,653,646 | 8/1997 | Negishi . | |
| 5,665,010 | 9/1997 | Mori . | |

| | | | |
|---|---|---|---|
| 5,685,781 | 11/1997 | Pedersen et al. . | |
| 5,692,971 | 12/1997 | Williams . | |
| 5,735,753 | 4/1998 | Hoffmeyer . | |
| 5,792,007 | 8/1998 | Billings . | |
| 5,882,268 | 3/1999 | McIntosh | 473/316 |

FOREIGN PATENT DOCUMENTS

| | | |
|---|---|---|
| 371665 | 5/1932 | United Kingdom . |
| 404995 | 1/1934 | United Kingdom . |
| 439308 | of 1935 | United Kingdom . |
| 447319 | 5/1936 | United Kingdom . |
| 447496 | 5/1936 | United Kingdom . |
| 447270 | 6/1936 | United Kingdom . |
| 447320 | 6/1936 | United Kingdom . |
| 465414 | 5/1937 | United Kingdom . |
| 482164 | 3/1938 | United Kingdom . |
| 483995 | 4/1938 | United Kingdom . |
| 518 699 | 3/1940 | United Kingdom . |
| 876414 | 8/1961 | United Kingdom . |
| 1159714 | 7/1969 | United Kingdom . |
| 1201648 | 12/1970 | United Kingdom . |
| 1446444 | 8/1976 | United Kingdom . |
| 2 040 693 | 9/1980 | United Kingdom . |
| 2 053 004 | 2/1981 | United Kingdom . |
| 2 053 698 | 2/1981 | United Kingdom . |
| 2146906 | 5/1985 | United Kingdom . |
| 2 250 443 | 6/1992 | United Kingdom . |
| 2 273 662 | 6/1994 | United Kingdom . |
| 92/10244 | 6/1992 | WIPO . |
| WO 99/02223 | 1/1999 | WIPO . |

GOLF CLUB SHAFT

This application is a continuation-in-part of U.S. patent applications Ser. No. 08/672,362 filed Jun., 28, 1996, now U.S. Pat. No. 5,935,017 and U.S. Ser. No. 29/075,725 filed Jul. 8, 1997, now U.S. Pat. No. D. 418,566.

TECHNICAL FIELD OF THE INVENTION

The present invention generally relates to golf clubs, and more particularly to golf clubs having an improved shaft providing improved tip stability and club head speed for various players with different swing speeds.

BACKGROUND OF THE INVENTION

Conventional sets of golf clubs include three types clubs called "woods," "irons," and putters. Each club is made up of a shaft having a club head attached to one end and a grip attached to the other end. The club head includes a face for striking a ball. The angle between the face and the shaft is called "loft." Each type of club has a distinguishable shaft length and club head loft.

The shaft length and the club head loft help determine the playing characteristics of the club. As the shaft length increases, the club head speed upon impact with the ball increases, and the ball travels farther. As the shaft length decreases, the club head speed upon impact with the ball decreases, and the ball travels a shorter distance. In addition, as the loft increases, the potential arc or trajectory of the ball in flight also increases. As the ball trajectory increases, the more the potential ball distance decreases. Conversely, as the loft decreases, the potential arc or trajectory of the ball in flight also decreases. As the ball trajectory decreases, the more the potential ball distance increases.

In an ideal swing the golfer aligns the club head with the golf ball, so that the club head impacts the ball straight. This allows the ball to move in the desired direction. A fast-swinging player is typically a tour or experienced male player. These players swing an iron at speeds of about 100 mph, and between 80 to 90 mph, respectively. Therefore, these players have the ability to generate enough speed for long distances. However, these players can experience problems with shaft tip stability. Tip stability is defined by the torsional rigidity and bending stiffness at the tip relative to the upper portion of the shaft.

Most shafts today are wider at the grip and taper down to a narrow tip end near the club head. When a fast-swinging player swings a club, torque forces tend to twist the tip of the shaft causing the club head to strike the ball at an angle. Furthermore, when the club head strikes the ball, a force is exerted on the club head by the ball, which tends to bend the shaft tip and un-square the club head. This twisting and bending of the tip leads to inaccurate shots.

In an effort to provide more tip stability, a number of solutions have been attempted. Some conventional golf club shafts have substituted various stronger composite materials in the shaft tip end in order to build up the sidewalls of the tip end. These composite materials, however, may be difficult to work with and expensive. In addition, these composite materials may have only limited benefits. Because the tip end has a small diameter, only a small amount of composite material may be added to the tip end, which may not significantly improve tip stability.

Other conventional shafts may attempt to improve the playing characteristics of a golf club and the tip stability by increasing the overall diameter of the entire shaft or by employing shafts with varying diameters or tapers. An oversized diameter shaft may have a stiffer, more stable tip end, but it may also have an oversized grip section that may be too large for most players. In addition, the oversized diameter shaft may be too heavy or too stiff, so that it does not feel good to most golfers. Other conventional shafts may have non-constant tapers that improve the playing characteristics of the golf club, but these non-constant tapered shafts are more difficult to manufacture and more costly. These non-constant taper shafts may also be too heavy. It is desirable to improve shaft tip stability for fast-swinging players, while maintaining the feel of a conventional club.

Slow-swinging players have a need for tip stability, due to for example, maintaining accuracy after the club head impacts the ground. The stiff shaft that fast-swinging players use may not improve the games of slow-swinging players. However, tip stability is still a consideration. Slow-swinging players are usually seniors, women, or inexperienced players. These players swing irons at speeds of for example 70 mph for seniors and 65 mph for women. Therefore, they have difficulty generating enough speed for long distances. These players also have difficulty getting a higher trajectory with the ball.

To combat their distance problem, these players typically use more flexible shafts, which create a whip-action. The whip-action compensates for the physical or skill deficits of these players, and accelerates the club head, which causes the head to drive the ball longer. Although ball rise is important, the need for whip-action must be balanced against the player's need for tip stability.

Since slow-swinging players have difficulty getting the higher ball trajectory, they tend to drive the ball into the ground, which limits the ball distance. Long irons do not alleviate this problem, because of their low loft. In an effort to increase their distance, these players may resort to using middle and short irons for their "distance" shots. The middle and short irons, which have greater loft, will help increase the vertical flight of their shots. However, players that use these clubs for "distance" shots sacrifice the potential distance benefits of the long irons for the loft of the other irons.

As golf has gained popularity, there is a need for clubs, which improve the games of players with varying skills. In order to minimize the cost of providing clubs for fast-swinging and slow-swinging players, it is desired that clubs be devised that may be used to improve tip stability for fast-swinging players, and distance and ball trajectory for slow-swinging players.

SUMMARY OF THE INVENTION

In accordance with the present invention, a set of golf club shafts comprises a plurality of shafts where the length of each shaft from a tip end to a butt end decreases along the set. Each shaft further includes a tip section, a lower section, and an upper section. The tip section connects with a golf club head, and extends from the tip end of the shaft. The lower section extends from the tip section. The upper section extends from the lower section to the butt end of the shaft. The tip section connects with a golf club head, and extends from the tip end of the shaft. The lower section includes a tapered section and a reverse taper section. The tapered section extends from the tip section and ends at the reverse taper section. The tapered section extends from the reverse taper section to the tip section, and the diameter decreases toward the tip section. The reverse taper section decreases in diameter in a direction away from the tip section and the reverse taper section ends at the upper section. Each shaft has a distance from the tip end to the reverse taper section that varies along a portion of the set as the shaft length along the set decreases. In one embodiment, the distance from the tip end to the reverse taper section is constant along a portion of the set as the shaft length decreases. In another embodiment, the distance from the tip end to the reverse taper section increases along a portion of the set as the shaft length decreases. In yet another embodiment, the distance from the tip end to the reverse taper section decreases along a portion of the set as the shaft length decreases.

Depending on the swing speed of the player, the distance of the reverse taper sections from the tip section can be varied to increase stability of the tip or to increase ball trajectory. As a result of modifications in the distance of the reverse taper section, similar sets of clubs can be produced for players with a variety of skills.

In another embodiment the present invention is a golf club shaft that includes a tip end, an opposed butt end, a tip section, a lower section, and an upper section. The tip section connects with a golf club head, and extends from the tip end of the shaft. The lower section extends from the tip section. The upper section extends from the lower section to the butt end of the shaft. The shaft has bending modulus values that vary from the tip end to the butt end. The shaft is shaped so that from a distance of about 150 mm from the tip end to a distance of about 200 mm from the tip end, the bending modulus values are greater than about 300 Kgf×$mm^2$. In another embodiment, the bending modulus from the distance of about 150 mm to about 250 mm decreases an amount greater than 50 Kgf×$mm^2$.

The present invention further includes a golf club shaft comprising an upper section, a tip section, a lower section, and a resilient plug. The tip section connects with a golf club head. The lower section includes a tapered section and a reverse taper section. The tapered section extends from the tip section and ends in the reverse taper section. The tapered section increases in diameter in a direction away from the tip section. The reverse taper section decreases in diameter in a direction away from the tip section and the reverse taper section ends in the upper section. The resilient plug is wedged inside the shaft and extends along the reverse taper section. The resilient plug is formed from a sound absorbing material. In one embodiment, the plug is formed of an open celled foam, in another embodiment the plug is formed of a closed celled foam.

DETAILED DESCRIPTION OF THE DRAWING

Figure 1:
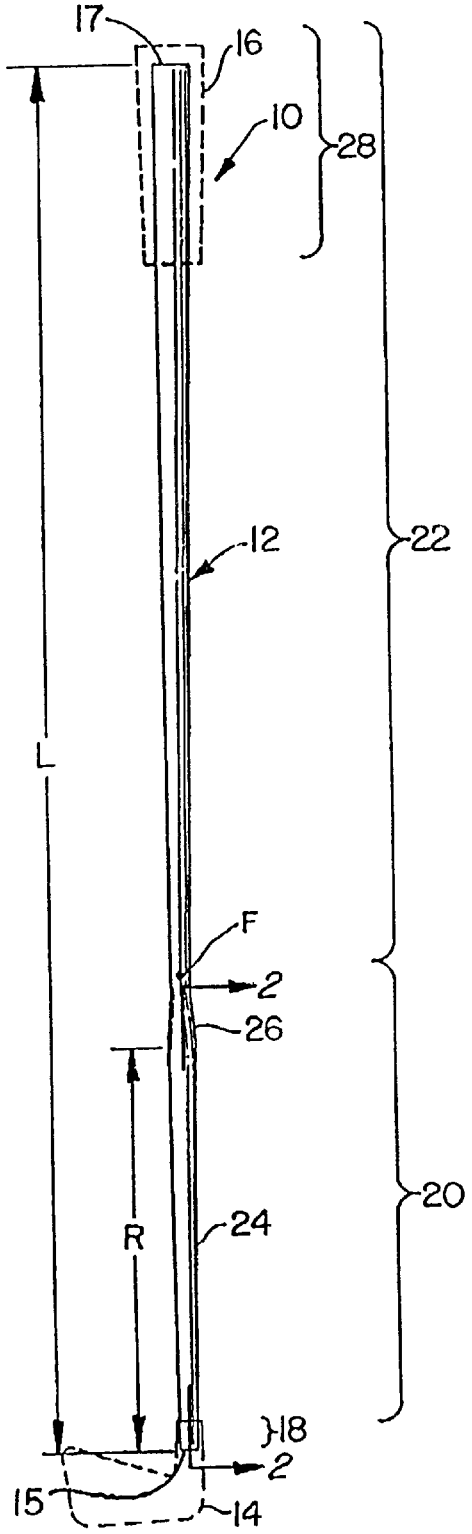
FIG. 1 is a side view of a composite golf club shaft according to the present invention.
Figure 2:
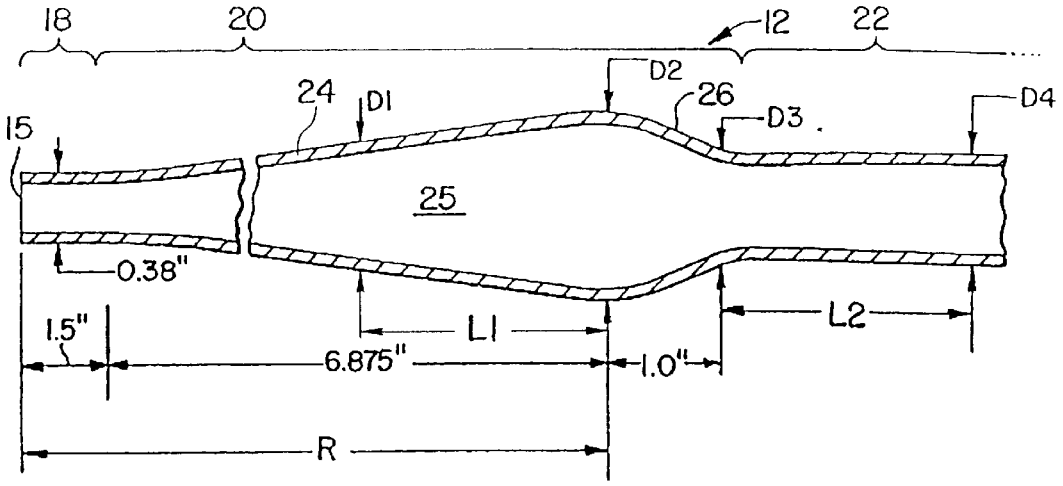
FIG. 2 is an enlarged partial cross-sectional view of the composite golf club shaft along line 2—2 of FIG. 1.

Referring to FIG. 1, a composite golf club 10 includes a shaft 12, a club head 14 (shown in phantom) at a tip end 15, and a grip 16 (shown in phantom) at a butt end 17. The total length L of the shaft 12 is the length from the tip end 15 to the butt end 17. The shaft 12 is integrally formed and defined by tip section 18, a lower section 20, and an upper section 22. Referring to FIG. 2, the shaft 12 further is a hollow tubular structure defining an interior channel 25. The shaft illustrated in FIG. 2 is formed according to the "bladder molding" technique, to be discussed in more detail below. This technique allows the inner cavity to be formed with an inner diameter that follows the contour of the outer diameter, which may have various taper rates.

Referring to FIG. 1, the tip section 18 extends from the tip end 15 to the lower section 20. The club head 14 (shown in phantom) is attached in a conventional manner to the tip section 18.

The lower section 20 includes a tapered section 24 and a reverse taper section 26. The tapered section 24 extends from the tip section 18 to the reverse taper section 26. The diameter of the tapered section 24 decreases or tapers toward the tip section 18. The reverse taper section 26 or hump section extends from the first taper section 24 ending at the upper section 22. The reverse taper section 26 has a diameter that decreases in a direction away from the tip section 18, and a generally frustoconical shape. Referring to FIG. 2, the reverse taper section 26 begins at a maximum diameter D2 of the lower section 20.

Referring to FIG. 1, the reverse taper section 26 defines where a flex point F is located. The flex point F is the point at which the shaft 12 has its maximum deflection when flexed. It may be determined by clamping both ends of the shaft so that neither end can move, flexing the shaft, and identifying the point of maximum deflection. The location of the flex point determines the trajectory that a golf ball (not shown) may have when struck.

Referring to FIG. 1, the reverse taper section 26 is spaced from the shaft tip end 15 a distance designated by an arrow R. The distance R is the sum of the lengths of the tip section 18 and the length of the tapered section 24. As the distance R increases, the farther the reverse taper section 24 and the flex point F are from the tip section 18, which decreases the ball trajectory. As the distance R decreases, the closer the reverse taper section 26 and flex point F are to the tip section 18, which increases the ball trajectory.

Referring to FIGS. 1 and 2, the upper section 22 extends from the reverse taper section 26 to the butt end 17. The diameter of the upper section 22 tapers toward the reverse taper section 26. The upper section further includes a butt section 28. The butt section 28 may have a constant diameter or be tapered. The grip 16 (shown in phantom) is attached in a conventional manner to the butt section 28.

Referring to FIG. 2, the dimensions of the composite shaft 12 will now be discussed; however, the present invention is not limited to these dimensions. The lengths, diameters and taper rates may be varied depending on the desired stiffness of the shaft and the desired location of the flex point. U.S. patent application Ser. Nos. 08/672,362 and 29/075,725 filed on Jun. 28, 1996, and Jul. 8, 1997, respectively, are incorporated herein by reference in their entirety.

Referring to FIGS. 1 and 2, the length of the tip section 18, is about 1.5 inches. The diameter of the tip section 18 is constant at about 0.38 inches. The constant diameter of the tip section 18 allows the tip section 18 to receive the golf club head 14 (shown in phantom).

Referring to FIG. 2, the length of the tapered section 24 is about 6.875 inches. The diameter of the tapered section 24, which is designated with an arrow D1, increases away from the tip section 18. The diameter D1 is 0.4845 inches. The diameter of the upper end of the tapered section 24, which is designated with an arrow D2, is about 0.5 inches. The diameter D2 is the maximum diameter of the lower section 20, and designates the beginning of the reverse taper section 26.

Referring to FIG. 2, the length of the reverse taper section 26 is about 1.0 inch. The diameter of the upper end of the reverse taper section 26, which is designated by an arrow D3, is about 0.401 inches. The diameter of the reverse taper section 26 decreases from diameter D2 to diameter D3 in a direction away from the tip section 18.

Referring to FIG. 1, the length of the upper section 22 may be 29.125 inches depending on the type of shaft being formed. Referring to FIG. 2, at the upper end of the reverse taper section 26, the decreasing reverse taper section diameter D3 changes to the slowly increasing upper section diameter D4. The diameter of the upper section 22, which is designated by an arrow D4, is about 0.4072 inches. The upper section may include an area of substantially constant diameter adjacent diameter D3. Referring to FIG. 1, the diameter of the butt section 28 may be approximately 0.600 inches.

Referring to FIG. 2, the length of the reverse taper section 26, is short as compared to the length of the tapered section 24 and the length of the upper section 22. The reverse taper section 26 provides a rapid transition between the oversized tapered section 24, and the more slowly tapered upper section 22. This transition may be as short as possible. The length of the reverse taper section 26 may be from about 0.5 inches to about 2.0 inches. A longer length reverse taper section 26 leads to a longer section of the shaft that has a larger diameter that is stiffer.

Referring to FIG. 2, in the preferred embodiment of the invention, the taper per unit length of the lower section 20 is related to the taper per unit length of the upper section 22 by the following equation:

$$\frac{(D2 - D1)}{(D4 - D3)} \geq 2$$

where D1 is the diameter of the lower section 20 at a distance L1 below D2 or the reverse taper section 26, D2 is the diameter of the upper end of the tapered section 24, D3 is the diameter of the lower end of the upper section 22, and D4 is the diameter of the upper section 24 at a distance L2 above D3. The locations at which the diameters D1, D2, D3, and D4 are measured, are shown in FIG. 2. This relationship is valid if the distance L1 is equal to the distance L2.

For the shaft 12 (D2–D1) or the taper rate of the tapered section 24 is equal to (0.5 inches–0.4845 inches), which is 0.0155 inches. For the shaft 12 (D4–D3) or the taper rate of the upper section 22 is equal to (0.4072 inches–0.401 inches), which is 0.0062 inches. The ratio according to the equation of these two taper rates is about 2.5. This satisfies the equation, because any shaft with a ratio of greater than or equal to two may be within the scope of the invention. That is to say any shaft where the taper per unit length of the tapered section is at least twice that of the upper section is within the scope of the invention.

In one embodiment, the taper rate of the lower section 20 can vary along the length. For example, the taper rate from the tip section 18 to a predetermined point in the first tapered section 20 may be 0.023 inches per inch of length, and from the predetermined point to the reverse taper section may be 0.020 inches diameter per inch of length. The taper rate of the reverse taper section 26 may be 0.069 inches diameter per inch of length.

The taper rate of the upper section 22 can vary along the length. For example, the taper rate from the end of the reverse taper section 26 at D3 to a predetermined point on the upper section 22 may be 0.005 inches diameter per inch of length, and from the predetermined point to the butt section 28 may be 0.008 inches diameter per inch of length.

The shaft 12 may be formed by utilizing the "bladder molding" technique. This technique utilizes a hollow mandrel having a plurality of perforations therethrough. The interior of the mandrel is connected to a source of air. A rubber or plastic expandable sheath is disposed over the mandrel. The composite material is laid up on the sheath similar to conventional methods forming an assembly. The assembly is inserted into a two part mold, which forms a cavity in the shape of the finished shaft. Air is flowed under pressure to the interior of the mandrel and through the perforations. This air exerts a force on the sheath causing it to expand and press the composite material against the mold cavity into the shape of the shaft. Once the composite material cures, the composite material has assumed the shape of the mold, and the assembly is removed from the mold. Then the mandrel and sheath are successively removed from the shaft. Conventional finishing steps may be used to complete the shaft, such as sanding, grinding, and painting. Referring to FIG. 2, the inner diameter of the cavity 25 does not match that of the mandrel outer diameter but that of the mold, unlike a composite shaft formed using conventional methods of wrapping the composite over the mandrel without the sheath.

The shaft may also be formed using conventional methods. These methods include laying up a composite material on a tapered solid mandrel. The composite lay up forms a tube with an inner channel with an inner diameter that matches the outer diameter of the mandrel. The reverse taper section is formed by layers of material that are added in the proper locations on the tube. The composite material used may include graphite and thermoplastic resin or thermosetting resin. The laid up shaft is cured, then ground so that surface of the shaft is shaped to form a smooth curve from the tapered section 24 to the reverse taper section, and is shaped to form a smooth curve from the reverse taper section to the upper section. Thus, the transitions between these sections are gradual.

Figure 3:
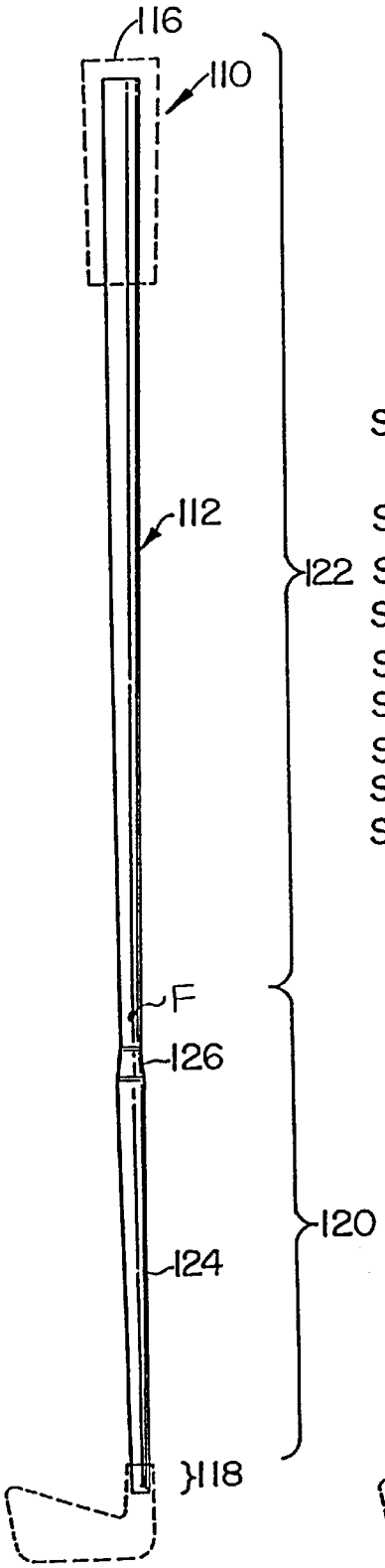
FIG. 3 is a side view of a steel golf club shaft according to the present invention.

Referring to FIG. 3, a steel golf club 110 is shown. The components of the club 110 that are similar to the components of the composite club 10 (as shown in FIG. 1) are represented by the same number proceeded by the numeral "1." The surface of the shaft 112 is drawn to form an angle from the tapered section 124 to the reverse taper section 126, and is drawn to form an angle from the reverse taper section 126 and the upper section 122. The reverse taper section 126 also has a frustoconical shape. Thus, the transitions between these sections are abrupt.

Figure 4:
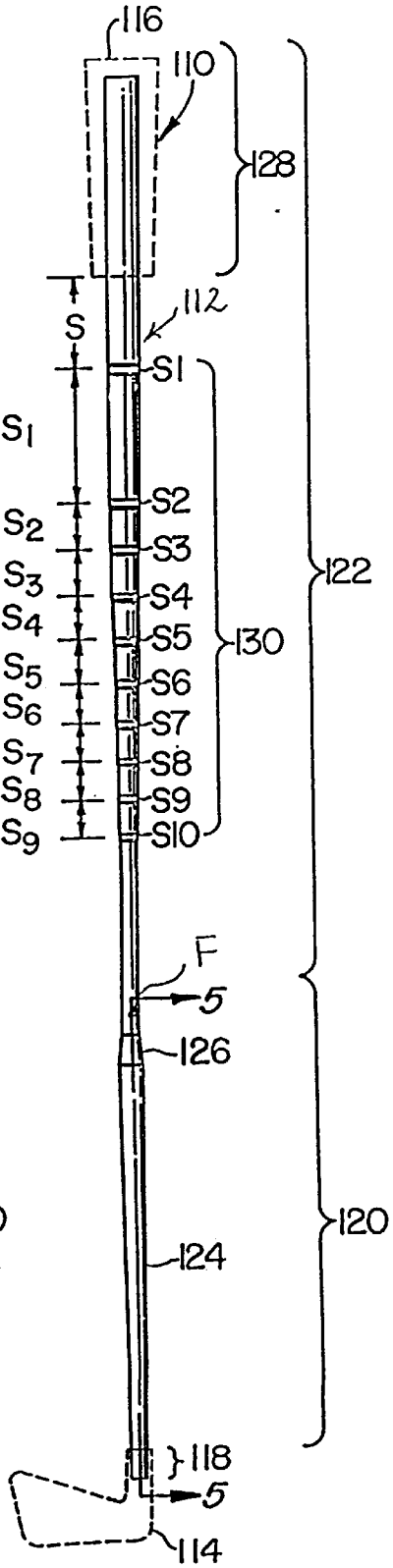
FIG. 4 is a side view of another embodiment of the steel golf club shaft according to the present invention.

Referring to FIG. 4, the steel golf club 110 has been modified so that the tapered upper section 122 is formed with a stepped portion 130, which includes a plurality of stepped sections S1 through Sn, in this embodiment n is equal to nine. The stepped portion 130 is located at a length, which is designated by the distance S, from the butt section 128. The length between each step is designated by distances $S_1$ through $S_9$, respectively.

The length and location of the stepped portion 130, as well as the length of each step may be modified to change the stiffness of the upper section 122 as well as the shaft. As the distance S increases, the stepped portion 130 moves closer to the reverse taper section 126, and shaft stiffness tends to increase. As the distance S decreases, the stepped portion 130 moves farther from the reverse taper section 126, and shaft stiffness tends to decrease. As the distances $S_1$ through $S_9$ decrease, the steps are closer together and the shaft stiffness tends to increase. As the distances $S_1$ through $S_9$ increase, the steps are farther apart, and the shaft stiffness tends to decrease. As the number of steps increases, the shaft stiffness tends to increase. A tour player, for example, who desires an extra stiff shaft 112, may have a shaft with numerous steps that are closer to the reverse taper section 126. A senior player, for example, who desires a more flexible shaft 112, may have a shaft with fewer steps that are farther from the reverse taper section 126. Thus, a variety of geometries of the stepped portion 130 may be chosen in order to produce the proper feel of the club.

Figure 5:
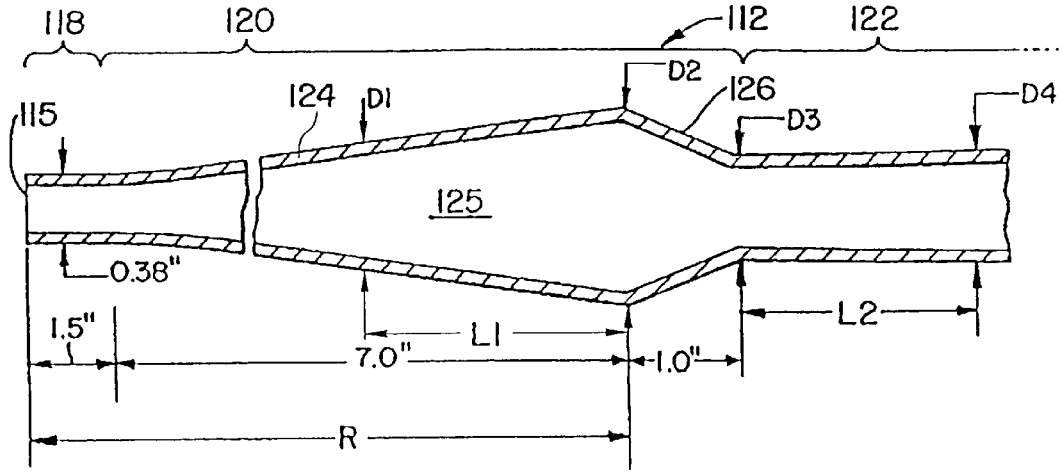
FIG. 5 is an enlarged partial cross-sectional view of the steel golf club shaft along line 5—5 of FIG. 4, having a plug removed for clarity.

Referring to FIGS. 3–5, the dimensions of the steel shaft 112 will now be discussed; however, the present invention is not limited to these dimensions. The lengths, diameters and taper rates may be varied depending on the desired stiffness of the shaft and the desired location of the flex point.

Referring to FIGS. 4–5, the length of the tip section 118 is about 1.5 inches. The diameter of the tip section 118 is constant at about 0.38 inches. The constant diameter of the tip section allows the tip section 118 to receive the golf club head 114.

Referring to FIG. 5, the length of the tapered section 124 is about 7 inches. The diameter of the tapered section 124, which is designated with an arrow D1, increases away from the tip section 118. The diameter of the upper end of the tapered section 124, which is designated with an arrow D2, is about 0.498 inches. The diameter D2 is the maximum diameter of the lower section 120 and designates the beginning of the reverse taper section 126.

Referring to FIG. 5, the length of the reverse taper section 126 is about 1.0 inch. The diameter of the upper end of the reverse taper section 126, which is designated by an arrow D3, is about 0.398 inches. The diameter of the reverse taper section 126 decreases from diameter D2 to diameter D3 in a direction away from the tip section 118. Referring to FIGS. 4 and 5, the length of the upper section 122 may be 29.125 inches depending on the type of shaft formed. The diameter of the upper section 122, which is designated by an arrow D4, is about 0.398 inches. At the upper end of the reverse taper section 126, the decreasing reverse taper section diameter D3 changes to the slowly increasing upper section diameter D4. The upper section 122 may include an area with a substantially constant, diameter adjacent the reverse taper section diameter D3.

Referring to FIG. 5, the length of the reverse taper section 126, is short as compared to the length of the tapered section 124, and the length of the upper section 122. The reverse taper section 126 provides a rapid transition between the oversized tapered section, and the more slowly tapered upper section 122. This transition may be as short as possible. The length of the reverse taper section 126 may be from about 0.5 inches to about 2.0 inches. A long length reverse taper section leads to a longer section of the shaft that has a larger diameter that is stiffer.

Referring to FIG. 5, in the preferred embodiment of the invention, the relationship between D1, D2, D3, and D4 for the shaft 112 may also satisfy the aforementioned equation. In one embodiment, the taper rate of the lower section is 0.169 inches per inch of length.

Figure 7:
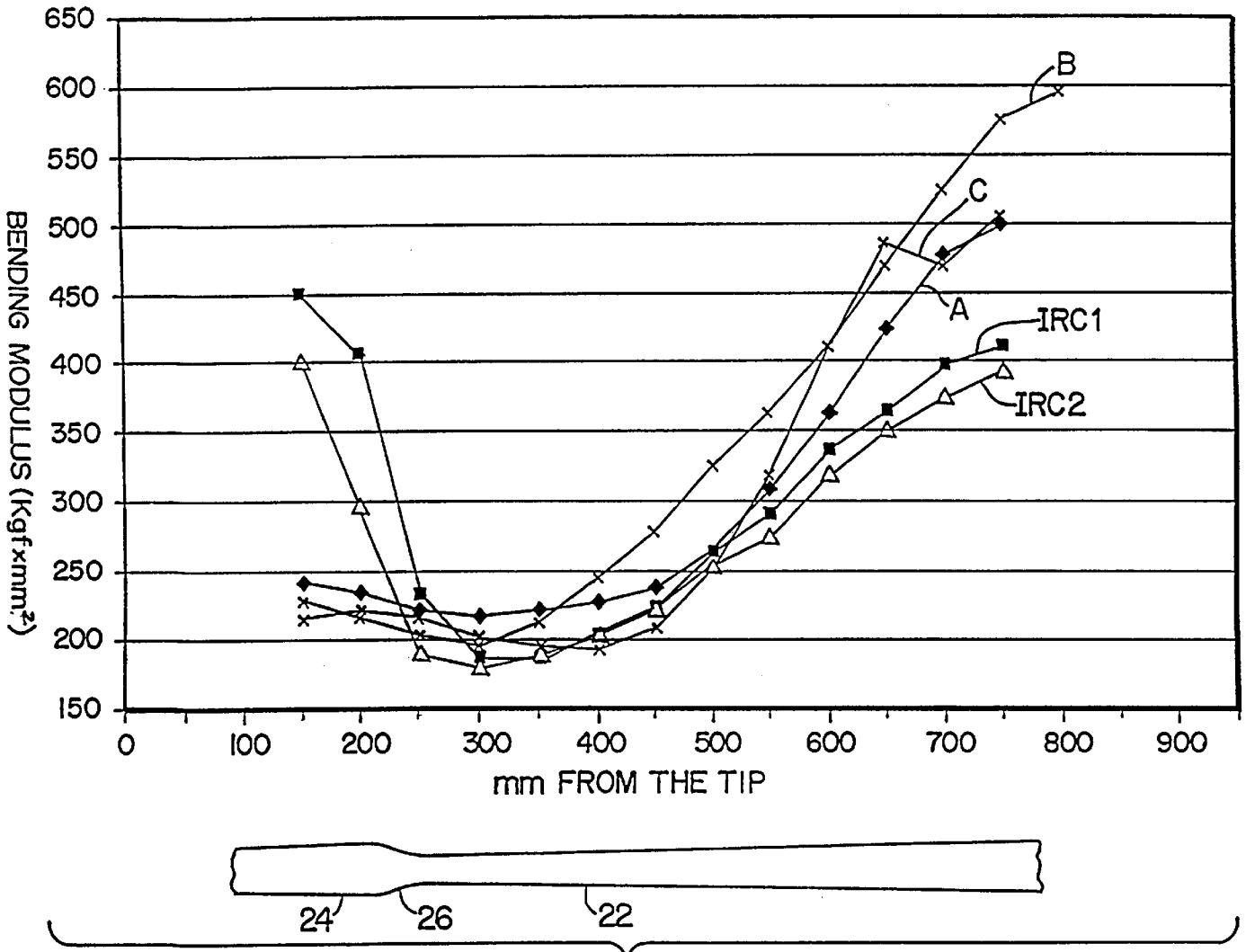
FIG. 7 is a graph that illustrates bending modulus versus shaft length to compare various conventional regular-flex composite shafts to two embodiments of regular-flex composite shafts in accordance with the present invention.

The advantage of the invention in providing a greater taper rate in the lower section 120 of the shaft is that greater stiffness and stability can be obtained in the lower section 120. Referring to FIG. 7, a graph illustrates variations in the bending modulus versus shaft length for a portion of the shaft. The term "bending modulus" as used in the specification and appended claims means the value of the Modulus of Elasticity multiplied by the Moment of Inertia. This relationship is usually represented by the term "EI." In the graph the point represents not only the bending modulus value at that discrete point a predetermined distance from the tip, but also represents the bending modulus a predetermined distance on either side of the point. These values are determined by supporting a shaft and applying a vertical load at the desired location. The measurement of bending modulus for that point will also be the bending modulus for the shaft adjacent that point.

Various conventional regular-flex composite shafts A–C are compared to two embodiments of regular-flex composite shafts IRC1 and IRC2 in accordance with the present invention. The bending modulus is directly related to the stiffness of the shaft, which determines the shaft's resistance to bending and torque. The bending modulus of golf club shafts IRC1 and IRC2 within the tapered section 24 from about 6 inches (150 mm) from the tip to about 8 inches (200 mm) from the tip is almost twice that of the conventional shafts A–C. Thus, the inventive shafts IRC1 and IRC2 have increased tip stability. In the reverse taper section 26, where the diameter of the shaft decreases, the bending modulus of the shafts IRC1 and IRC2 quickly drops and is approximately equal to the conventional shafts A–C. As described above, the short, reverse taper section 26 of the shaft rapidly reduces the bending modulus of the shafts, so that a low flex point may be obtained. In the upper section 22 of the shaft, the shafts IRC1 and IRC2 have a lower bending modulus than the conventional shafts A–C.

Since the geometry of the lower section tends to stiffen the entire shaft, it has been found that with inventive shafts IRC1 and IRC2, the stiffness of the shaft may be varied along the upper section 22. This can be done by varying the wall thickness of the shaft along its length, since stiffness varies directly with wall thickness. This can also be done by using different materials in the case of a composite shaft or modifying the taper rate. The bending modulus along the upper section gradually increases away from the reverse taper section 26. Thus, the closer the location to the reverse taper section 26, the more flexible the shaft.

The shaft IRC1 has a higher bending modulus throughout the curve than that of IRC2. This occurs because the shaft IRC1 has the reverse taper section at a higher location than the shaft IRC2, which makes the former shaft less flexible than the latter, The location of the reverse taper section on IRC1 is 8.5" from the tip. The location of the reverse taper section on IRC2 is 7.5" from the tip. Thus, for the IRC1 shaft more of the shaft length is devoted to the increased diameter lower section, which stiffens the entire shaft, as compared to the IRC2 shaft. Additionally, the wall thickness, materials, and lay-up pattern was varied to further decrease the stiffness of the IRC2 shaft.

Figure 8:
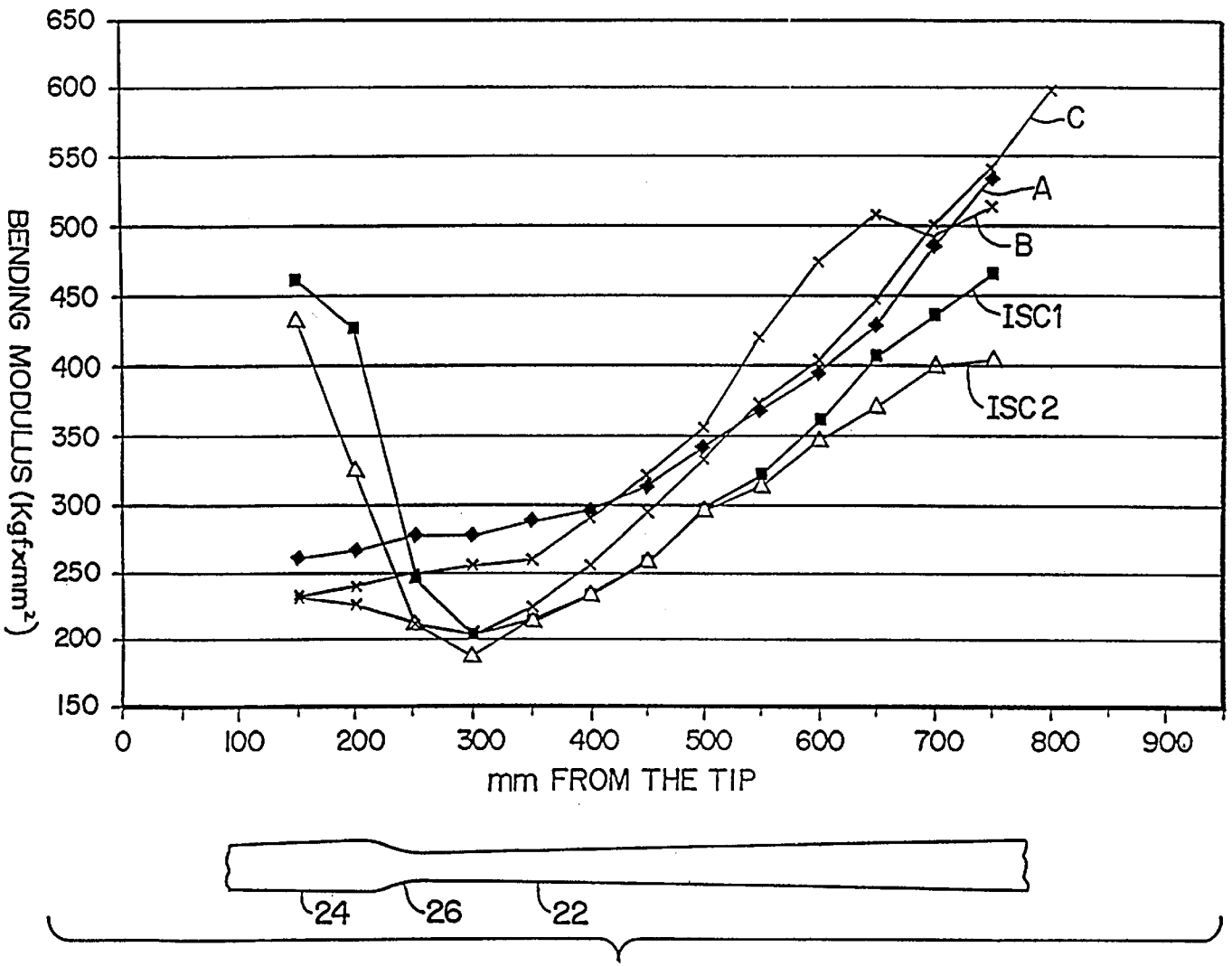
FIG. 8 is a graph that illustrates bending modulus versus shaft length to compare various conventional stiff-flex composite shafts to two embodiments of the stiff-flex composite shafts in accordance with the present invention.

Referring to FIG. 8, a graph illustrates variations in the bending modulus versus shaft length for a portion of the shaft. Various conventional stiff-flex composite shafts A–C are compared to two embodiments of stiff flex composite shafts ISC1 and ISC2 in accordance with the present invention. The bending modulus is directly related to the stiffness of the shaft, which determines the shaft's resistance to bending and torque. The bending modulus of golf club shafts ISC1 and ISC2 within the tapered section 24 from about 6 inches (150 mm) from the tip to about 8 inches (200 mm) from the tip is almost twice that of the conventional shafts A–C . Thus, the inventive shafts ISC1 and ISC2 have increased tip stability. In the reverse taper section 26, where the diameter of the shaft decreases, the bending modulus of the shafts ISC1 and ISC2 quickly drops, and is approximately equal to the conventional shafts A–C. As described above, the short, reverse taper section 26 of the shaft rapidly reduces the bending modulus of the shafts so that a low flex point may be obtained. In the upper section 22 of the shaft, the shafts ISC1 and ISC2 have a lower bending modulus than the conventional shafts A–C . The bending modulus along the upper section 22 gradually increases away from the reverse taper section 26. It has been found that with shafts ISC1 and ISC2, the stiffness of the shaft may be varied along the upper section 22. This can be done by varying the wall thickness of the shaft along its length, stiffness varies directly with wall thickness. The bending modulus along the upper section gradually increases away from the reverse taper section 26. Thus, the closer the location to the reverse taper section 26, the more flexible the shaft.

The shaft ISC1 has a higher bending modulus throughout the curve than that of ISC2. This occurs because the shaft ISC1 has the reverse taper section at a higher location than the shaft ISC2, which makes the former shaft less flexible than the latter. The location of the reverse taper section on ISC1 is 8.5" from the tip. The location of the reverse taper section on ISC2 is 7.5" from the tip. Thus, for the ISC1 shaft more of the shaft length is devoted to the increased diameter lower section, which stiffens the entire shaft, as compared to the ISC2 shaft. Additionally, the wall thickness was varied to further decrease the stiffness of the ISC2 shaft.

Although the bending modulus profiles of the shafts ISC1 and ISC2 are similar to the bending modulus profiles of the shafts IRC1 and IRC2 (as shown in FIG. 7); the stiff-flex shafts ISC1 and ISC2 have greater bending modulus values than those of the regular-flex shafts IRC1 and IRC2, as is required for the various flex ratings. Thus, the stiff-flex shafts are stiffer than the regular-flex shafts; however, both have increased tip stability over the conventional shafts A–C.

Figure 9:
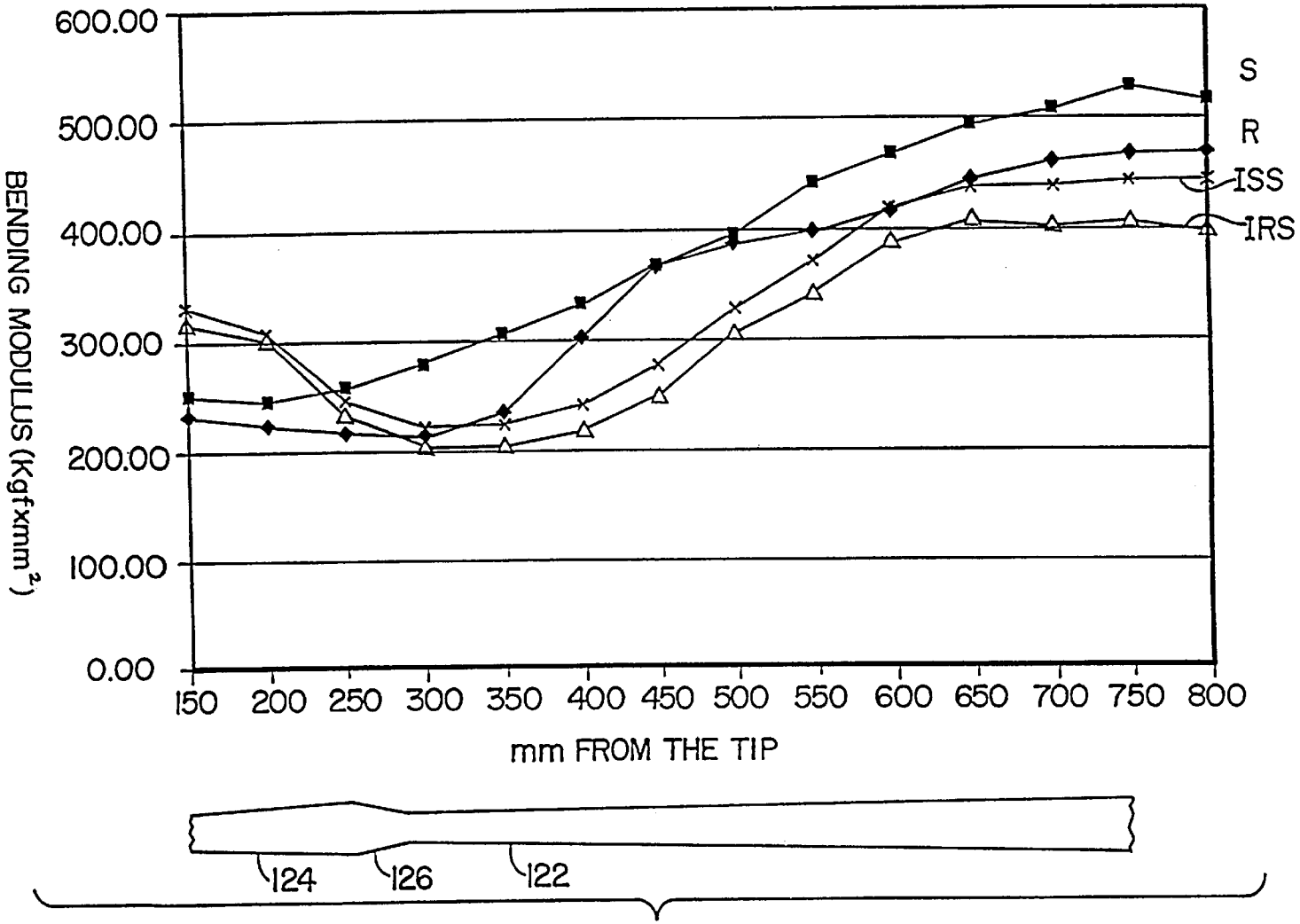
FIG. 9 is a graph that illustrates bending modulus versus shaft length to compare various conventional regular-flex and stiff-flex steel shafts to two embodiments of regular-flex and stiff-flex steel shafts in accordance with the present invention.

Referring to FIG. 9, a graph illustrates variations in the bending modulus versus shaft length for a portion of the shaft. Various conventional steel shafts R and S are compared to steel shafts IRS and ISS in accordance with the present invention. The shafts R and IRS are combination regular-flex shafts. The shafts S and ISS are stiff-flex shafts. The bending modulus is directly related to the stiffness of the shaft, which determines the shafts resistance to bending and torque. The bending modulus of golf club shafts IRS and ISS within the tapered section 124 from about 6 inches (150 mm) from the tip to about 8 inches (200 mm) from the tip is about 100 Kgf×mm$^2$ greater than that of the conventional shafts R and S, respectively. Thus, the inventive shafts IRS and ISS have increased tip stability. In the reverse taper section 126, where the diameter of the shaft decreases, the bending modulus of the shafts IRS and ISS quickly drops and is approximately equal to that of the conventional shafts R and S. As described above, the short, reverse taper section 126 of the shaft rapidly reduces the bending modulus of the shaft so that a low flex point may be obtained. In the upper section 122, the shafts IRS and ISS have a lower bending moduli than the conventional shafts R and S. The bending modulus along the upper section gradually increases away from the reverse taper section 126. It has been found that with shafts IRS and ISS, steps must be taken to decrease the stiffness along the upper section 122, so that playability of the shaft does not suffer due to the stiffening effect of the reverse taper section 126. This can be done by varying the wall thickness of the shaft along its length, since stiffness varies directly with wall thickness. This can also be done by changing the stepped pattern as discussed above. The shaft ISS has a higher bending modulus throughout the curve than that of IRS as is required for the shafts'associated flex ratings. Thus, the stiff-flex shaft is stiffer than the regular-flex shaft; however, both have increased tip stability over the conventional shafts.

Figure 10:
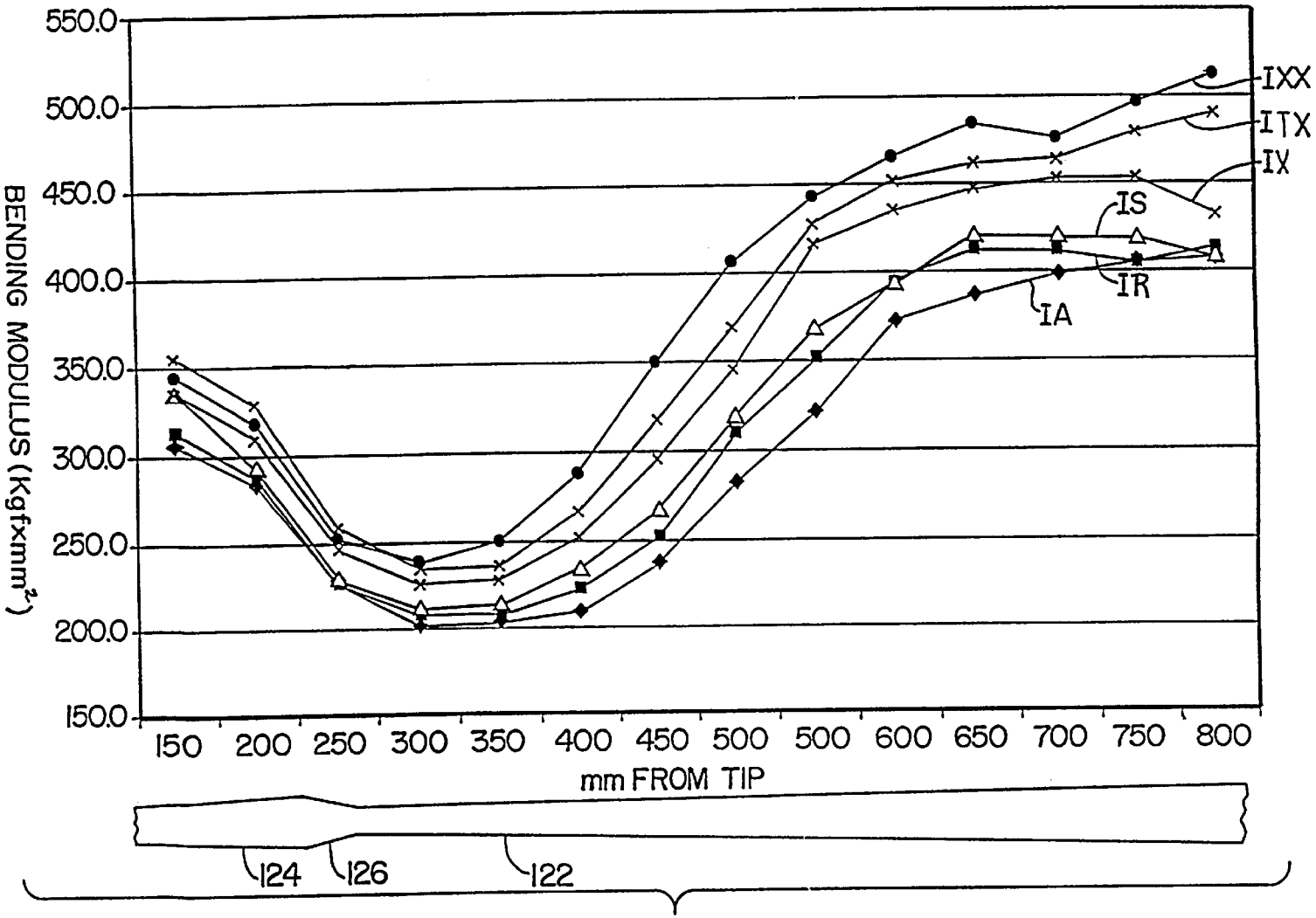
FIG. 10 is a graph that illustrates bending modulus versus shaft length to compare various flex steel shafts in accordance with the present invention.

Referring to FIG. 10, a graph illustrates the bending modulus versus shaft length for a portion of the shaft of various flex steel shafts IA, IR, IS, IX, ITX, and IXX in accordance with the present invention. The bending modulus of golf club shafts IA through IXX within the tapered section 124 from about 6 inches (150 mm) from the tip to about 8 inches (200 mm) from the tip is greater than 260 Kgf×mm$^2$. In the reverse taper section 126, the stiffness of the shafts IA through IXX quickly drops. As described above, the short, reverse taper section 126 of the shaft rapidly reduces the bending modulus of the shaft so that a low flex point may be obtained. In the upper section 122, the bending modulus of the shafts IA and IXX gradually increases away from the reverse taper section 126. Thus, the closer to the reverse taper section 126, the more flexible the shafts. It has been found that with shafts IA and IXX, steps must be taken to decrease the stiffness along the upper section 122 so that playability of the shaft does not suffer due to the stiffening effect of the reverse taper section. This can be done by varying the wall thickness of the shaft along its length, stiffness varies directly with wall thickness. This can also be done by changing the stepped pattern as discussed above. The shaft bending modulus of each shaft increases from shaft IA through shaft IXX as is required by the shafts'associated flex ratings of average-flex A (for seniors), regular-flex R (for general use), stiff-flex S (for men), extra stiff (for men), tour-extra stiff TX, and double extra stiff XX, respectively. All of these shafts have increased tip stability over the conventional shafts.

Table I provides test data to show the differences in weight, torque, deflection, and frequency between conventional shafts and shafts according to the present invention. The shaft of Examples 1 is a conventional regular-flex steel shaft, and the shaft of Example 2 is a regular-flex steel shaft of the present invention. The shaft of Example 3 is a conventional stiff-flex steel shaft, and the shaft in Example 4 is a stiff-flex steel shaft of the present invention.

The results show that for shafts with the regular-flex the stiffening effect of the reverse taper section allows a weight reduction of 5 grams, and for the stiff-flex shafts a reduction of 14 grams. This weight reduction allows the weight to be placed in the club head which results in the golfer swinging the club more quickly, which will increase the potential distance of the ball once hit.

Torque is determined by holding the shaft rigidly at the butt end, applying a twisting load of 1 ft-lbf at the tip end, and measuring the angle of twist of the inventive shafts. The inventive shafts of Examples 2 and 4 have a lower torque than the conventional shafts of Examples 1 and 3. Thus, illustrating that the shafts of the present invention are more resistant to twisting at the tip.

Deflection is measured by holding the shaft rigidly at the butt end, attaching a weight near the tip end, and measuring the deflection of the tip. The deflection of the inventive shaft of Example 4 is 0.50° less than the deflection of the conventional shaft of Example 3, thus the inventive shaft of Example 4 is less likely to bend that the conventional shaft.

Frequency is measured by holding the shaft rigidly at the butt end, attaching a weight to the tip, bending and releasing the shaft, and measuring number of oscillations of the shaft in cycles per minute (cpm). The number of oscillations can be counted by a frequency machine. For this test a Brunswick machine was used with a 250 gram mass. The greater the number of oscillations, the stiffer the shaft. It can be seen that the regular-flex inventive shaft of Example 2 has a frequency 12 cpm less than the conventional shaft of Example 1; therefore, the inventive shaft is more flexible. It can also be seen that the stiff-flex inventive shaft of Example 4 has a frequency 20 cpm less than the conventional shaft of Example 3; therefore the inventive shaft is more flexible. The inventive shafts of Examples 2 and 4 have better feel and playability.

TABLE I

| | Example 1 | Example 2 | Example 3 | Example 4 |
|---|---|---|---|---|
| Weight (g) | 110 | 105 | 124 | 110 |
| Torque (°) | 2.0 | 1.9 | 2.0 | 1.9 |
| Deflection (°) | — | — | 9.75 | 9.25 |
| Frequency (cpm) | 296 | 284 | 313 | 293 |

Figure 11:
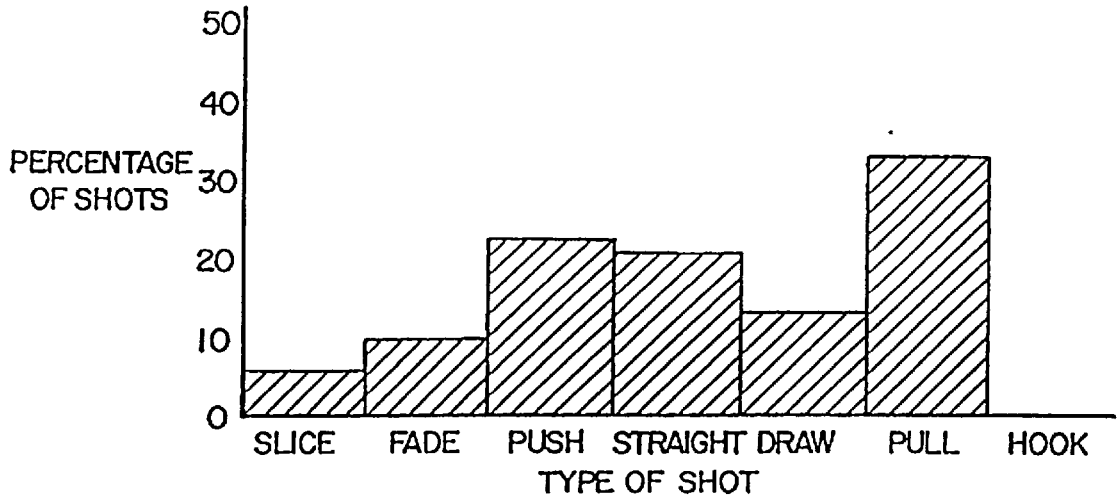
FIG. 11 (Prior Art)
FIG. 11 is a bar graph that illustrates the accuracy of golf shots for a conventional golf club shaft.
Figure 12:
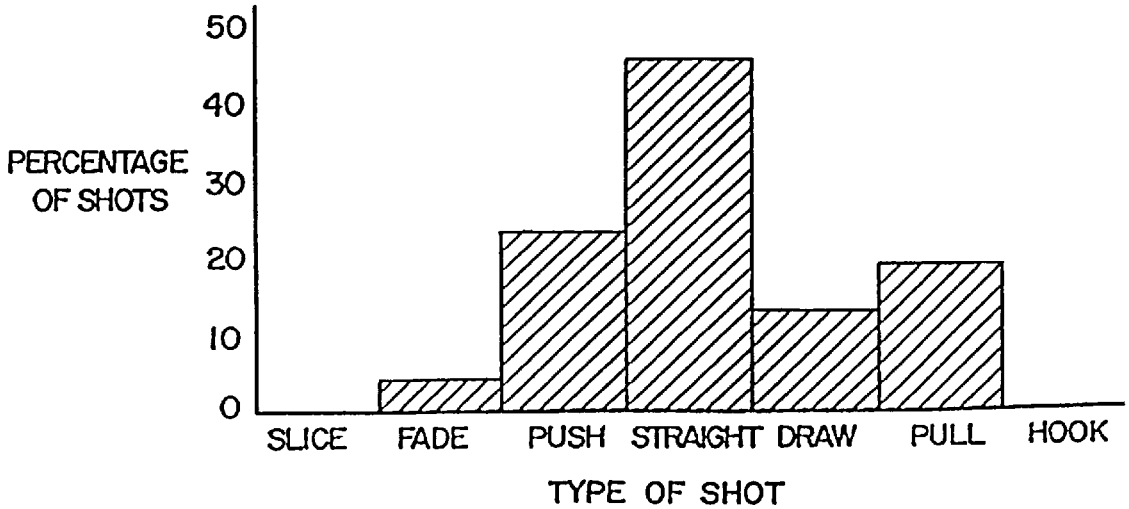
FIG. 12 is a bar graph that illustrates the accuracy of golf shots for a golf club shaft of the present invention.

The stiffer lower section of the inventive shaft tends to reduce any twisting or bending of the shaft, so that the club head strikes the golf ball squarely, leading to more accurate golf shots. This result will now be discussed with reference to FIGS. 11 and 12. FIG. 11 illustrates the accuracy of shots using a conventional shaft. FIG. 12 illustrates the accuracy of shots using a golf club of the present invention. The conventional shaft had about 5% slice shots, 9% fade shots, and 22% push shots. In addition, the conventional shaft also had about 12% draw shots, and 32% pull shots. This combines for a total of 80% inaccurate shots. Inaccurate shots are those that were not straight. Only 20% of the shots are straight and accurate. By contrast, a golf shaft of the present invention had only about 55% inaccurate shots, and about 45% straight shots. This increase in the accuracy of the shots with the inventive shaft may be attributable to the increased tip stability of the shaft.

Figure 6:
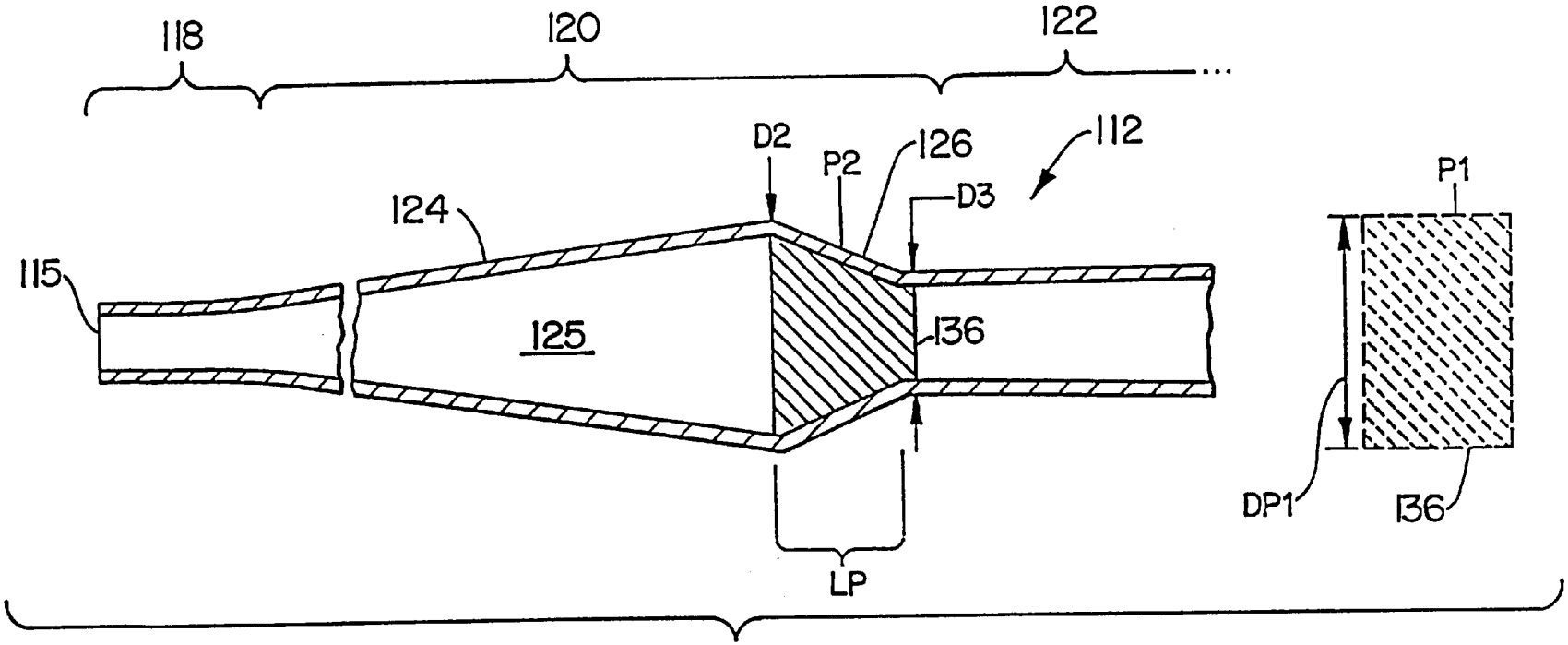
FIG. 6 is an enlarged cross-sectional view of the steel golf club shaft as shown in FIG. 5, showing the plug in an installed position and a removed position.

A resilient plug may be used generally with a composite or a steel shaft. For example, referring to FIGS. 3 and 6, the steel shaft 112 further includes the reverse taper section 126 having a predetermined volume, and the resilient plug 136. The resilient plug 136 dampens vibrations generated when the club 114 strikes a ball (not shown). Prior to installation in the shaft 112, the plug 136 (as shown in phantom) is positioned at stage P1. At stage P1, the plug 136 has a size such that the volume of the plug is greater than the predetermined volume within the shaft along the reverse taper section. The size of the plug is defined by a plug length LP and a plug original outer diameter DP1, which is larger than the width the shaft interior chamber 125 at the lower end of the reverse taper section 126. In order to install the plug 136 in the shaft 112, the plug 136 must be compressed in a manner which reduces the plug volume to less than the predetermined volume, so that the plug 136 can be inserted into the interior chamber 125. Once inserted, a rod (not shown) may be used to push the plug 136 to stage P2. The rod can be actuated manually or automatically. The location of the plug can be verified by a number of techniques including X-raying the shaft 112.

At stage P2, the plug 136 extends along the reverse taper section 126. Since the plug material is resilient or elastically deformable and the compressive force is removed, the plug 136 expands in volume to match the predetermined volume within the shaft. The expanded plug 136 cannot return to its original volume, so the plug 136 exerts a force on the shaft 112. This force helps retain the plug 136 in the proper location. The taper of the first taper section 124 toward the tip end 115 helps prevent the plug from moving toward the tip end 115. The taper of the reverse taper section 126 down to the diameter D3 helps prevent the plug from moving toward the upper section 122.

A number of factors should be considered when selecting the proper material for the plug. These factors include resiliency, behavior when exposed to water, sound absorbency, and weight. The material should be resilient enough to compress with minimal manual effort in order to be inserted into the shaft 112, and expand once released.

In most golf clubs, the interior chamber 125 of the shaft 112 is not a closed environment, thus the plug 136 may be exposed to moisture. It is preferred that the plug material be waterproof, which means that the material is not permanently affected by moisture. Thus, moisture does not adversely affect the resiliency, noise attenuation values, or change size of the plug during use. If the material absorbs moisture during use and shrinks or becomes less resilient, the plug may become dislodged in the shaft and move, which is undesirable.

Upon striking the ball with a steel club, vibrations are created that produce a ringing noise. It is preferred that the plug material used have sufficient ability to absorb and dampen this sound.

The weight distribution of the shaft is critical to the "feel" that the club will have when swung. If the plug alters the weight distribution of the club, the club may need to be redesigned to restore its "feel." Thus, it is preferred that the material used be light enough not to disturb the weight distribution of the club.

One suitable material, which satisfies the aforementioned criteria, is a foam material. An open cell or a closed cell foam may be used. An open cell foam may be natural or synthetic with a predominance of interconnected cells. An open cell foam may offer superior resiliency. A closed cell foam is a foam material with a predominance of non-interconnected cells. A closed cell foam may offer better moisture repellency.

One suitable commercially available closed cell foam is manufactured by the Aearo Company of Indianapolis, Ind. under the name AEARO E-A-R® CLASSIC™. This product is made of a polyvinyl chlorine (PVC) foam, which is a soft vinyl foam, that has about a 29 decibel noise reduction rating, and the ability to slowly recover its shape. The noise reduction rating is determined by testing in accordance with ANSI method 19-1974. Since the plug is made of PVC, the plug is waterproof, and upon exposure to moisture absorbs water, but does not change size or lose resiliency. This earplug has a cylindrical shape originally.

An advantage of using the AEARO E-A-R® CLASSIC™ is that its dimensions make it useful in existing shafts without modifications. This plug has an outer diameter DP1 of about 0.5 inches, and a plug length LP of about 0.75 inches. Since the diameter DP1 of 0.5 inches is greater than the diameter D2 of 0.498 inches less the shaft wall thickness, the plug exerts the necessary force on the shaft to remain in place. The plug length may vary depending on a number of factors, such as the length of the reverse taper section 126, the weight of the plug, and the necessary weight distribution of the club. A suitable plug length for this embodiment may be between about 0.5 inches to about 1.5 inches. The plug may also be used in composite shafts and may provide some vibration dampening in this application.

In another embodiment, foam pieces or ear plugs of various shapes, sizes, and materials may be used. For example, the AEARO E-A-R® SUPERSOFT™, which is a polyurethane foam plug and is shaped like a cone with a rounded tip, may be used. The AEARO E-A-R® TAPER-FIT® 2, which is a polyurethane foam plug that has a noise reduction rating of 32 decibels and is shaped like a cone with a rounded tip, the AEARO E-A-R® E-Z-FIT™, which is a polyurethane foam plug with a noise reduction rating of 28 and shaped like a bell, may be used. The AEARO E-A-R® ULTRAFIT®, which has a noise reduction rating of 21 decibels and is shaped like a cone with a rounded tip that is tapered using stepped sections, may be used.

Figure 13:
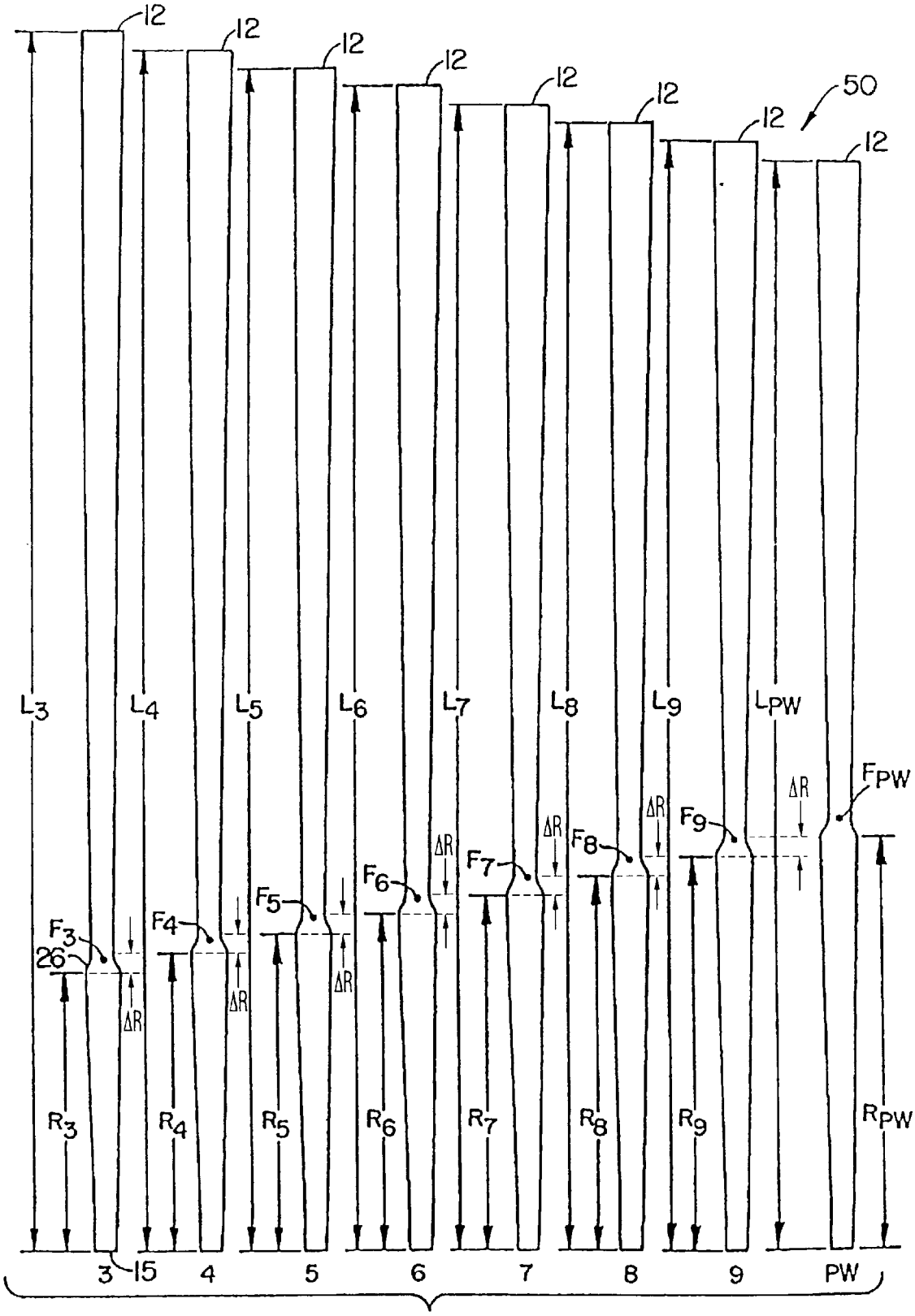
FIG. 13 is a front view of a set of composite golf club shafts according to the present invention.

The present invention may be applied to a set of shafts. Referring to FIGS. 13, a set of composite shafts 50 according to the present invention are illustrated. The set 50 is for use with "irons." However, the invention herein may be used with any other type of clubs, such as "woods."

The set 50 includes shafts designated 3 through 9 for the iron number and PW for the pitching wedge. Each shaft has a length, which is designated by arrows L3 through L9, and LPW, respectively. The shaft length decreases along the set, as the iron number increases. To form a club using each shaft, a club head (not shown) with a loft that increases along the set as the iron number increases would be attached to the shafts, as described above.

The reverse taper section distance, which is designated by the arrows R3 to RPW, is measured from the tip end 15 of each shaft to the beginning of the reverse taper section 26. Thus, the reverse taper section distance increases from the longest to the shortest shaft. The reverse taper section 26 is positioned away from the tip end 15 and 115 along the set of shafts 50. The change in the distance from the tip end to the reverse taper section from shaft to shaft is at a predetermined increment, designated R. This increment may be for example constant so that the change is linear or steady. The increment may not be constant for example a non-linear arrangement of reverse taper sections, as discussed below. Consequently, the flex point F for each shaft moves upwardly along the set. In use, the reverse taper section stiffens the tip and causes the ball to rise. This rise due to the shaft geometry is additional to that provided by the loft of the club head; therefore this action is called "supplemental loft." As the flex point moves upwardly, the supplemental loft provided by the reverse taper section decreases.

In the preferred embodiments, the reverse taper sections 26 on all of the shafts should be positioned within the lower third of each shaft 12. The arrangement illustrated may also be used with a set of steel shafts.

Figure 14:
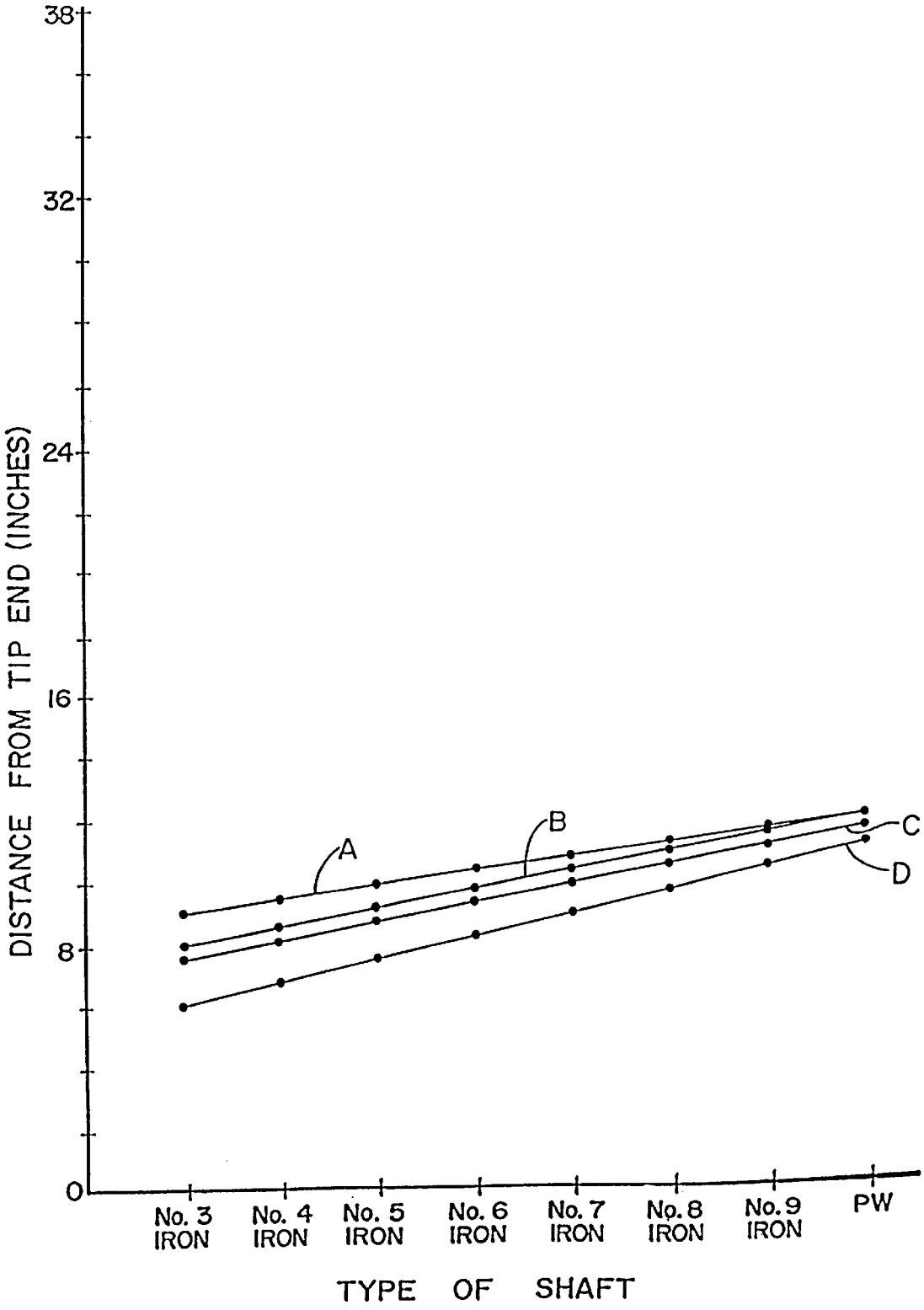
FIG. 14 is a graph that illustrates various arrangements for a reverse taper section for sets of shafts depending on a golfer's swing speed.

Referring to FIG. 14, each reverse taper section is represented by a point on each line, distance of each reverse taper section from the tip end varies between shafts. Each line represents a set of shafts and the reverse taper section locations for each shaft. If the user of the set is a fast-swinging player like a tour golfer, the reverse taper section should be high on the No. 3 iron. The reverse taper section distance is greater than 8 inches. The line A represents the arrangement of the reverse taper sections for a tour player's set of shafts. As the shaft length decreases along the set A, the velocity generated during a swing will theoretically decrease. Thus, less stiffening at the tip is necessary along the set, and moving the reverse taper section progressively away from the tip section will not be detrimental. Since tour players do not have difficulty getting the ball to rise, there is little need for supplemental loft. As a result, their clubs have the highest flex points of all the players, and the flex point moves upward along the set. This assures that as the loft of the club head increases, the supplemental loft decreases, which is desirable.

The line B represents the arrangement of the reverse taper sections along a set for an experienced male player with a fast swing. For example, on the No. 3 iron the reverse taper section distance is about 8 inches. Since these players require less stiffness at the tip than a tour players and more supplemental loft, the reverse taper sections are lower on the set B than on the set A. The reverse taper sections from the No. 3 to the pitching wedge are located farther from the tip end as the shaft length decreases.

The line C represents the arrangement of the reverse taper sections along a set for a senior player. For example, on the No. 3 iron the reverse taper section distance is about 7.5 inches. In another embodiment, the reverse taper section distance on the No. 3 iron for a male experienced player may also be 7.5 inches.

The line D represents the arrangement of the reverse taper sections for a female player. For example, on the No. 3 iron the reverse taper section distance is about 6.5 inches. Due to the slower swing speeds senior and female players generate, tip stability is less of a concern; therefore there are few adverse consequences on shot accuracy when the reverse taper section is lowered which decreases the tip stiffness. Lowering the reverse taper section for slow-swinging players on the long irons, lowers the flex point, thus allowing more supplemental loft when the ball is hit with the long iron. The supplemental loft allows these players to hit farther with their long irons. As a result of the present invention, these players will not have to sacrifice the speed generating benefit of longer shafts for loft.

The reverse taper section may move upward along the set, so that as the loft on the club head increases and the need for loft assistance decreases, the flex point moves upwardly. As a result, the supplemental loft decreases along the set. As a result of moving the reverse taper section location based on the player's swing speed, the same shaft configuration with minimal modifications may be used to produce clubs which provide benefits to a range of players. Both sets of shafts 50 and 150 may include the plug 136 (shown in FIG. 6) within the shafts.

Figure 15:
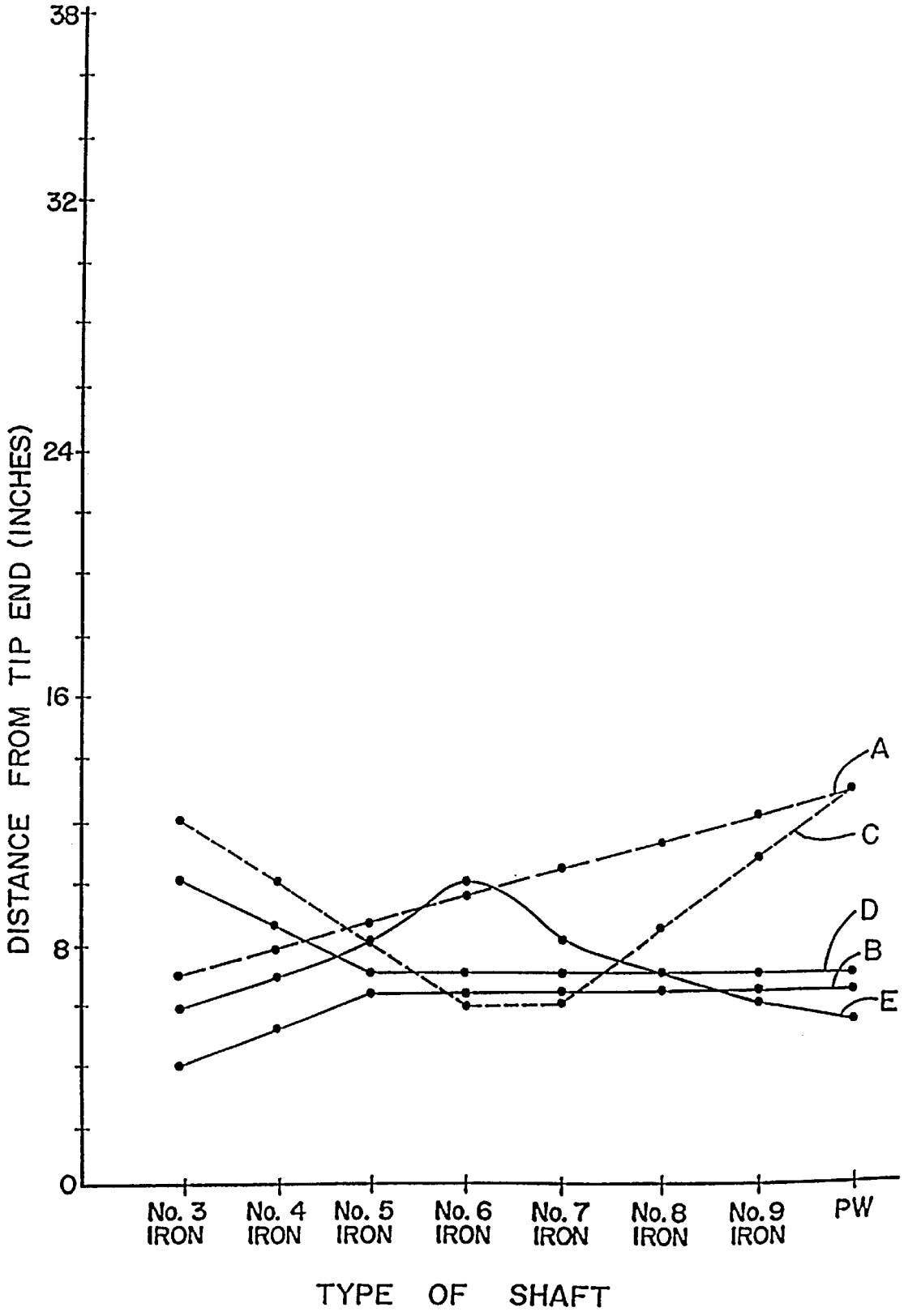
FIG. 15 is a graph that illustrates various other arrangements for the reverse taper section for sets of shafts.

FIG. 15 illustrates various sets of shafts A–E with a number of alternative arrangements for the reverse taper section locations. Each reverse taper section is represented by a point on each line. In the arrangement of set A, the reverse taper sections are farther from the tip end of the shaft as the length of the shafts decrease along the set. The change in the reverse taper distance between shafts is linear. However, it can be modified, for example to be exponential.

In the arrangement of set B, the reverse taper sections, are positioned farther from the tip end of the shaft from the No. 3 iron through the No. 5 iron. However, the reverse taper sections on the No. 6 iron through the pitching wedge are at a constant distance equal to the position on the No. 5 iron. A golfer may prefer this set, if for example the golfer wanted supplemental loft on the No. 3 through 5 clubs, but does not want supplemental loft on the remaining clubs.

In the arrangement of set C, the reverse taper sections, are positioned closer to the tip section from the No. 3 iron through the No. 6 iron in a linear fashion. Then the location of the No. 7 iron reverse taper section is constant with that of the No. 6 iron. From the No. 8 iron through the pitching wedge, the reverse taper sections are positioned farther from the tip section in a linear fashion.

In the arrangement of set D, the reverse sections are positioned closer to the tip section from the No. 3 iron through the No. 5 iron in a linear fashion. Then the location of the reverse taper sections on the No. 6 iron through the pitching wedge are constant with that of the No. 5 iron.

In the arrangement of set E, the reverse taper sections are positioned farther from the tip section from the No. 3 iron through the No. 6 iron. Then from the No. 7 iron through the pitching wedge the reverse taper sections are positioned closer to the tip section. In the arrangement represented by line E, the progression is non-linear. All of the sets A–E are depicted to show that a variety of reverse taper section arrangements can be used to customize a set of clubs to the particular golfer's needs. One advantage of the present invention is that sets of clubs can be custom fit to an individual golfer's needs, which leads to the non-linear graphs.

While embodiments of the present invention have been shown and described, various modifications may be made without departing from the scope and spirit of the present invention. Thus, this and all such modifications and equivalents are intended to be covered.

What is claimed is:

1. A set of a plurality of golf club shafts, with the length of each shaft from a tip end to a butt end decreasing along the set, each shaft comprising:

a) a tip section for connecting with a golf club head, said tip section extending from the tip end of the shaft;

b) a lower section including a first tapered section and a reverse taper section, said first tapered section tapering from the reverse taper section toward said tip section, said reverse taper section tapering from the first tapered section toward the butt end and being at a distance from said tip end;

c) an upper section including a grip section extending from the butt end to a second tapered section, the second tapered section tapering from the grip section and ending in the reverse taper section at a substantially constant taper rate; and d) the distance from the tip end to the reverse taper section of each shaft varying from shaft to shaft along at least a portion of the set as the shaft length along the set decreases; wherein the first taper section has a first taper per unit length and the second taper section has a second taper per unit length, and the first taper per unit length is greater than the second taper per unit length so that the stiffness of the lower section is greater than the stiffness of the upper section.

2. The set of shafts of claim 1, wherein said entire lower section of each shaft is located in the lower third of the shaft.

3. The set of shafts of claim 1, wherein change in said distance from the tip end to the reverse taper section from said one shaft to said next shaft in the set is constant.

4. The set of shafts of claim 1, wherein the distance from the tip end to the reverse taper section increases along a first portion of the set as the shaft length along the set decreases.

5. The set of claim 4, wherein the distance from the tip end to the reverse taper section is constant along a second portion of the set as the shaft length along the set decreases.

6. The set of claim 5, wherein the distance from the tip end to the reverse taper section decreases along a third portion of the set as the shaft length along the set decreases.

7. The set of shafts of claim 1, wherein the distance from the tip end to the reverse taper section increases along the entire set as the shaft length along the set decreases.

8. The set of shafts of claim 1, wherein each shaft is shaped so that the shaft forms a smooth curve from the first tapered section to the reverse taper section, and forms a smooth curve from the reverse taper section to the upper section.

9. The set of shafts of claim 1, wherein each shaft is shaped so that the shaft forms an angle from the first tapered section to the reverse taper section, and forms an angle from the reverse taper section to the upper section.

10. The set of shafts of claim 1, wherein each shaft is formed of a composite material.

11. The set of shafts of claim 1 wherein the reverse taper section has a frustoconical shape.

12. The set of shafts of claim 1, wherein each shaft is formed of steel.

13. The set of claim 12, wherein the second tapered section is formed by stepped sections.

14. The set of'shafts of claim 1, wherein each shaft is tubular and further includes a resilient plug wedged inside the shaft, the plug extending at least alone the reverse taper section and being formed from a sound absorbing material.

15. A tubular golf club shaft comprising:

a) an upper section;

b) a tip section for connecting with a golf club head;

c) a lower section including a tapered section and a reverse taper section, said tapered section tapering from the reverse taper section toward said tip section, said reverse taper section tapering from the tapered section to the upper section; and d) a resilient plug wedged inside the shaft, the plug extending substantially along only the reverse taper section and being formed from a sound absorbing material.

16. The golf club shaft of claim 15, wherein the plug is made of a closed cell foam.

17. The golf club shaft of claim 15, wherein the plug has a cylindrical shape.

18. The golf club shaft of claim 15, wherein the plug is made of an open cell foam.

19. The golf club shaft of claim 15, wherein the material has a noise rating of about 21 decibels or greater.

20. The golf club shaft of claim 15, wherein the material has a noise rating of about 28 decibels.

21. The golf club shaft of claim 15, wherein the material is a polyvinyl chlorine foam.

22. The golf club shaft of claim 15, wherein the reverse taper section defines a predetermined volume inside the shaft, and the resilient plug is of a size such that a plug volume is greater than the predetermined volume.

* * * * *

UNITED STATES PATENT AND TRADEMARK OFFICE

CERTIFICATE OF CORRECTION

PATENT NO. : 6,117,021

DATED : September 12, 2000

INVENTOR(S) : CROW et al.

It is certified that error appears in the above-identified patent and that said Letters Patent is hereby corrected as shown below:

Column 16, line 23, change "alone" to --along--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*